US009488025B2

(12) United States Patent
Curtis et al.

(10) Patent No.: US 9,488,025 B2
(45) Date of Patent: Nov. 8, 2016

(54) ROTATING CONTROL DEVICE WITH POSITIVE DRIVE GRIPPING DEVICE

(75) Inventors: Fredrick D. Curtis, Houston, TX (US); Sean A. Alley, Odessa, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 731 days.

(21) Appl. No.: 13/420,835

(22) Filed: Mar. 15, 2012

(65) Prior Publication Data

US 2012/0255783 A1 Oct. 11, 2012

(51) Int. Cl.
*E21B 33/08* (2006.01)

(52) U.S. Cl.
CPC ..... *E21B 33/085* (2013.01)

(58) Field of Classification Search
CPC ..... E21B 33/085
USPC ..... 166/84.1–84.1; 175/195; 277/326
See application file for complete search history.

(56) References Cited

U.S. PATENT DOCUMENTS

| | | | | |
|---|---|---|---|---|
| 3,128,614 | A * | 4/1964 | Auer | 464/163 |
| 3,561,723 | A * | 2/1971 | Cugini | 251/1.2 |
| 4,531,580 | A | 7/1985 | Jones | |
| 5,178,215 | A | 1/1993 | Yenulis et al. | |
| 5,224,557 | A | 7/1993 | Yenulis et al. | |
| 5,255,751 | A | 10/1993 | Stogner | |
| 5,277,249 | A | 1/1994 | Yenulis et al. | |
| 5,279,365 | A | 1/1994 | Yenulis et al. | |
| 5,647,444 | A * | 7/1997 | Williams | E21B 33/085 166/84.1 |
| 5,662,171 | A * | 9/1997 | Brugman et al. | 166/383 |
| 5,848,643 | A | 12/1998 | Carbaugh et al. | |
| 6,129,152 | A | 10/2000 | Hosie et al. | |
| 6,244,359 | B1 * | 6/2001 | Bridges et al. | 175/5 |
| 6,412,554 | B1 | 7/2002 | Allen et al. | |
| 7,308,954 | B2 | 12/2007 | Martin-Marshall | |
| 7,377,334 | B2 * | 5/2008 | May et al. | 175/57 |
| 7,635,034 | B2 | 12/2009 | Williams et al. | |
| 7,789,172 | B2 | 9/2010 | Williams | |
| 8,967,278 | B2 * | 3/2015 | Sugden | 166/380 |

(Continued)

FOREIGN PATENT DOCUMENTS

| | | | |
|---|---|---|---|
| CA | 702327 | A | 1/1965 |
| CN | 101942976 | A | 1/2011 |

(Continued)

OTHER PUBLICATIONS

Weatherford; "Weatherford Model 7800 Rotating Control Device", Product brochure 4593.00, dated 2007, 5 pages.

(Continued)

*Primary Examiner* — Kipp Wallace
(74) *Attorney, Agent, or Firm* — Chamberlain Hrdlicka

(57) ABSTRACT

A rotating control device can include a rotatably mounted seal which sealingly engages a drill string, and a gripping device which grips the drill string and thereby forces the seal to rotate with the drill string. A drilling method can include positioning a drill string in a rotating control device, gripping the drill string with a gripping device of the rotating control device, and rotating the drill string, gripping engagement between the gripping device and the drill string causing a seal of the rotating control device to rotate along with the drill string. A well system can include a drill string, and a rotating control device including a seal which sealingly engages the drill string and a gripping device which grippingly engages the drill string.

15 Claims, 7 Drawing Sheets

(56) References Cited

U.S. PATENT DOCUMENTS

| | | | | |
|---|---|---|---|---|
| 2003/0102136 | A1 | 6/2003 | Nelson et al. | |
| 2005/0236158 | A1 | 10/2005 | Miyahara | |
| 2006/0102387 | A1 | 5/2006 | Bourgoyne et al. | |
| 2008/0007256 | A1 * | 1/2008 | Waters | E21B 44/00 324/207.25 |
| 2010/0025117 | A1 | 2/2010 | Williams | |

FOREIGN PATENT DOCUMENTS

| | | | |
|---|---|---|---|
| RU | 76961 | U1 | 10/2008 |
| RU | 2369721 | C2 | 10/2009 |
| RU | 2374426 | C2 | 11/2009 |
| SU | 146263 | A1 | 11/1961 |
| SU | 1189995 | A1 | 11/1985 |

OTHER PUBLICATIONS

Weatherford; "Model 7875 Rotating Control Device", Product brochure 4594.01, dated 2010, 4 pages.

Weatherford; "Offshore Driling Hazard Mitigation: Controlled Pressure Drilling Redefines What is Drillable", Managed Pressure Drilling Article, dated Jan./Feb. 2009, 4 pages.

Halliburton; "RCD 1000 Rotating Control Device", H07903, dated Aug. 2010, 2 pages.

Smith Services; "Hold 2500 Rotating Control Device", product brochure, dated 2004, 4 pages.

Smith Services; "Marine Riser RCD", product presentation, dated Jul. 2009, 18 pages.

Elite Compression Services Ltd.; "RFCD—7500", product data, received Feb. 22, 2011, 1 page.

International Search Report and Written Opinion dated Nov. 14, 2011 for PCT application PCT/US2011/031367 filed on Apr. 6, 2011 (8 pages).

Chinese Search Report dated Oct. 16, 2014 for Chinese National Stage application 201180069652.5 filed on Sep. 27, 2013 (2 pages).

Extended European Search Report dated Jan. 19, 2015, issued in corresponding application No. 11863051.6,7 pgs.

Decision on Granting Issued in Corresponding RU Application No. 2013146663/03(072489). Dated Nov. 11, 2015 (11 Pages).

* cited by examiner

ROTATING CONTROL DEVICE WITH POSITIVE DRIVE GRIPPING DEVICE

CROSS-REFERENCE TO RELATED APPLICATION

This application claims the benefit under 35 USC §119 of the filing date of International Application Serial No. PCT/US11/31367 filed 6 Apr. 2011. The entire disclosure of this prior application is incorporated herein by this reference.

BACKGROUND

The present disclosure relates generally to equipment utilized and operations performed in conjunction with drilling a wellbore and, in an embodiment described herein, more particularly provides a rotating control device with a gripping device for positive drive of a seal in the rotating control device.

A rotating control device includes a seal which seals about a drill string therein. Changing the seal is time-consuming and labor-intensive, and can be hazardous in certain situations. Therefore, it will be appreciated that it would be desirable to prevent wear of, or damage to, the seal.

DETAILED DESCRIPTION

Figure 1:
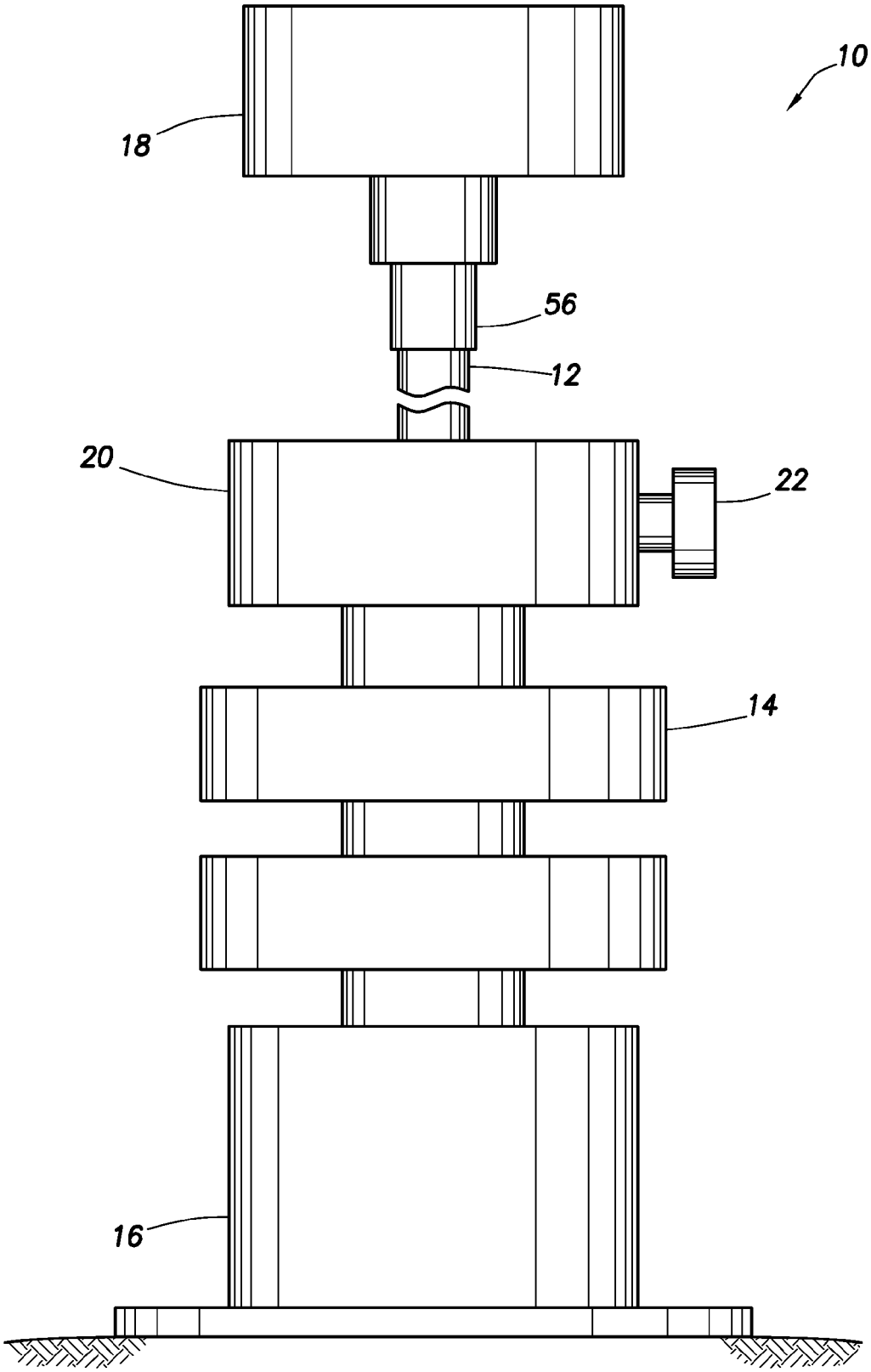
FIG. 1 is a representative elevational view of a well system and associated method which can embody principles of this disclosure.

Representatively illustrated in FIG. 1 is a well system 10 and associated method which can embody principles of this disclosure. In the well system 10, a drill string 12 extends downwardly through a blowout preventer (BOP) stack 14 on a wellhead 16. A top drive 18 (including, e.g., a hydraulic or electric motor) is used to rotate the drill string 12, to thereby cause rotation of a drill bit (not shown) at a far end of the drill string, and thereby drill into the earth.

A rotating control device (RCD) 20 seals off an annulus formed radially about the drill string 12, so that the well below the wellhead 16 is isolated from atmosphere. An outlet 22 allows for circulation of fluid (such as drilling mud, etc.) through the well below the RCD 20.

At this point it should be noted that the well system 10 is described herein as merely one example of a variety of well systems in which the principles of this disclosure can be incorporated. For example, it is not necessary for the drill string 12 to be rotated with the top drive 18, since in other examples the drill string could be rotated with a kelly and rotary table, or with a mud motor, etc. Thus, it will be appreciated that the principles of this disclosure are not limited in any manner to the details of the well system 10 and associated method depicted in the drawings or described herein.

Figure 2:
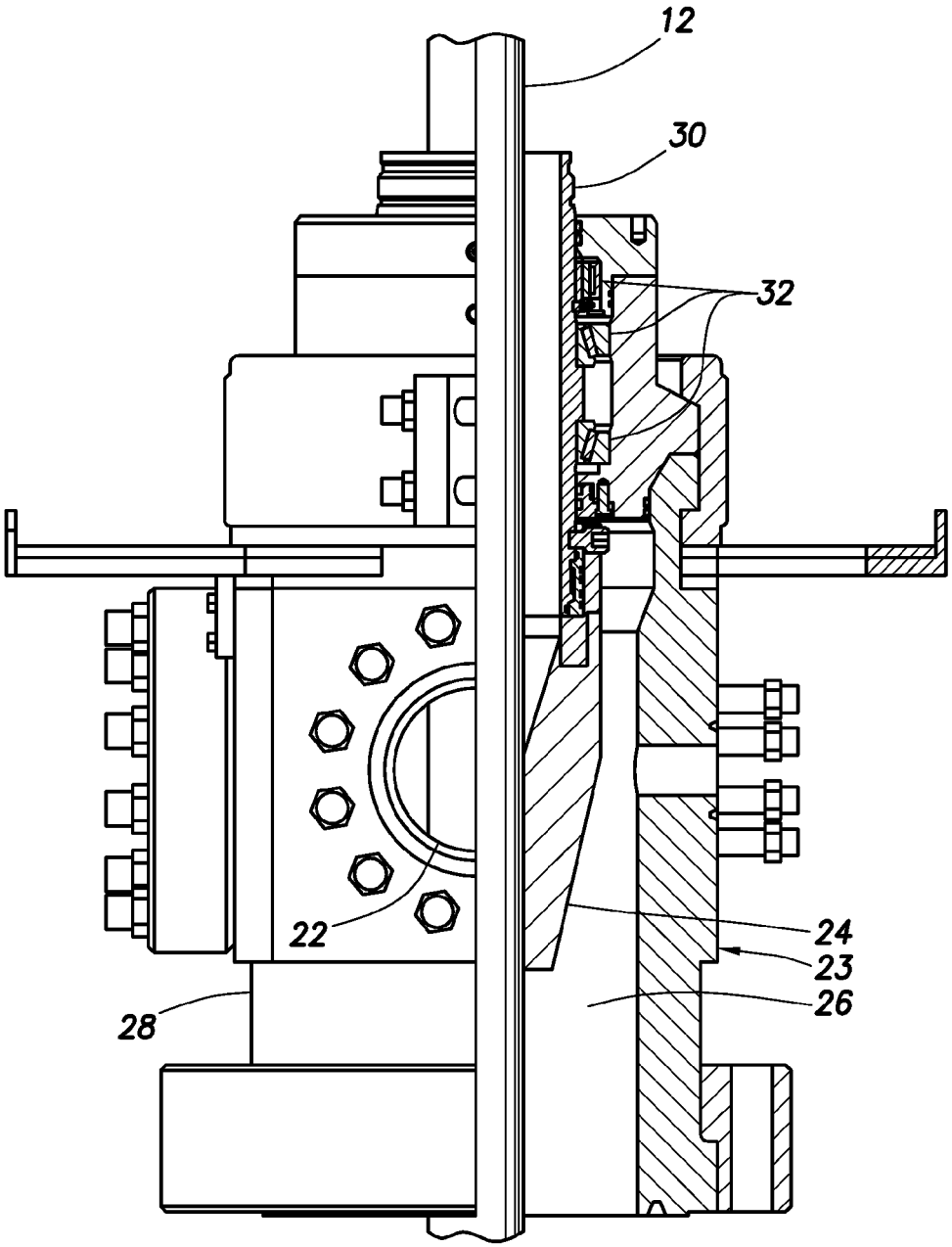
FIG.2 (PRIOR ART)
FIG. 2 is a representative cross-sectional view of a prior art rotating control device.

Referring additionally now to FIG. 2, a prior art rotating control device (RCD) 23 is representatively illustrated. The RCD 23 is of the type which includes a seal 24 for sealingly engaging the drill string 12, to thereby seal off an annulus 26 formed radially between the drill string and an outer body 28 of the RCD.

Rotating control devices are also known in the art as rotating blowout preventers, rotating heads, rotating control heads, rotating diverters, etc. Rotating control devices seal about drill strings while the drill strings rotate therein.

The seal 24 is mounted to a generally tubular mandrel 30. Bearings 32 provide for rotation of the mandrel 30 and seal 24 relative to the body 28.

Although the seal 24 and mandrel 30 can rotate with the drill string 12, friction between the seal and the drill string is relied on to cause rotation of the seal. Unfortunately, relative rotation between the drill string 12 and the seal 24 can cause damage to the seal, thereby shortening its useful life.

In some situations in the past, the mandrel 30 has been forced to rotate with the drill string 12 by engaging the mandrel with a bushing (not shown) on a kelly (not shown). However, this system only works if a kelly is used in the drilling operation (a kelly is not used if the top drive 18 of FIG. 1 is used to rotate the drill string), and this system requires that the seal 24 usually seals against the polygonal kelly (and not against the cylindrical drill string).

Figure 3:
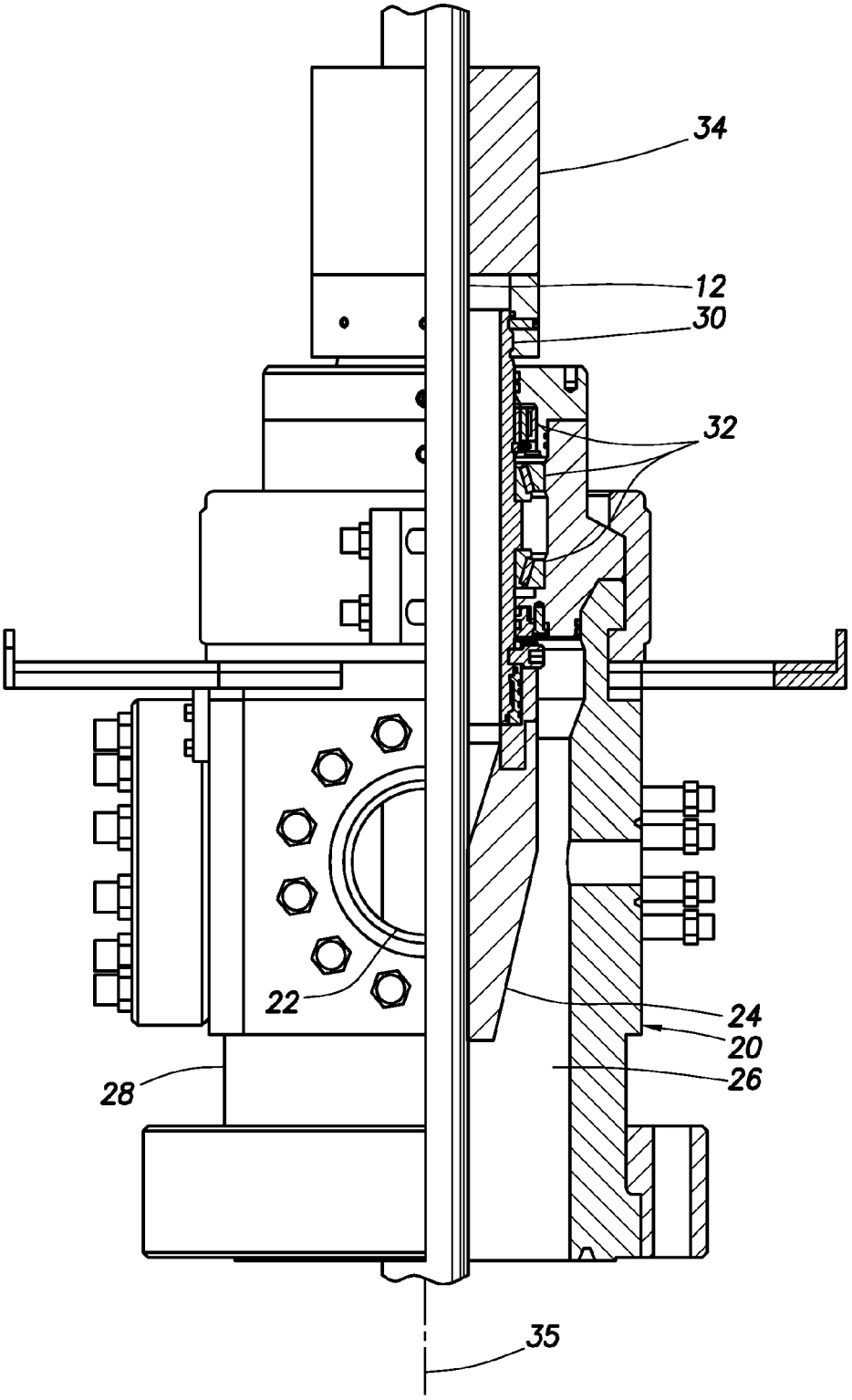
FIG. 3 is a representative partially cross-sectional view of a rotating control device which can be used in the well system and method of FIG. 1, and which can embody principles of this disclosure.

Referring additionally now to FIG. 3, the RCD 20 is representatively illustrated apart from the remainder of the well system 10. The RCD 20 is similar in many respects to the RCD 23, in that it includes the seal 24, body 28, mandrel 30 and bearings 32.

However, the RCD 20 further includes a gripping device 34 attached at an upper end of the mandrel 30. The gripping device 34 is depicted schematically in FIG. 3, but more detailed descriptions of examples of the gripping device are provided below.

The gripping device 34 grips the drill string 12 in a unique manner, and thereby forces the mandrel 30 and seal 24 to rotate with the drill string. This prevents (or at least mitigates) relative rotation between the drill string 12 and the seal 24. The drill string 12 can, however, displace longitudinally (e.g., in a direction along a longitudinal axis 35 of the drill string) through the gripping device 34 as a wellbore being drilled by the drill string deepens, or as the drill string is tripped into or out of the wellbore.

Figure 4:
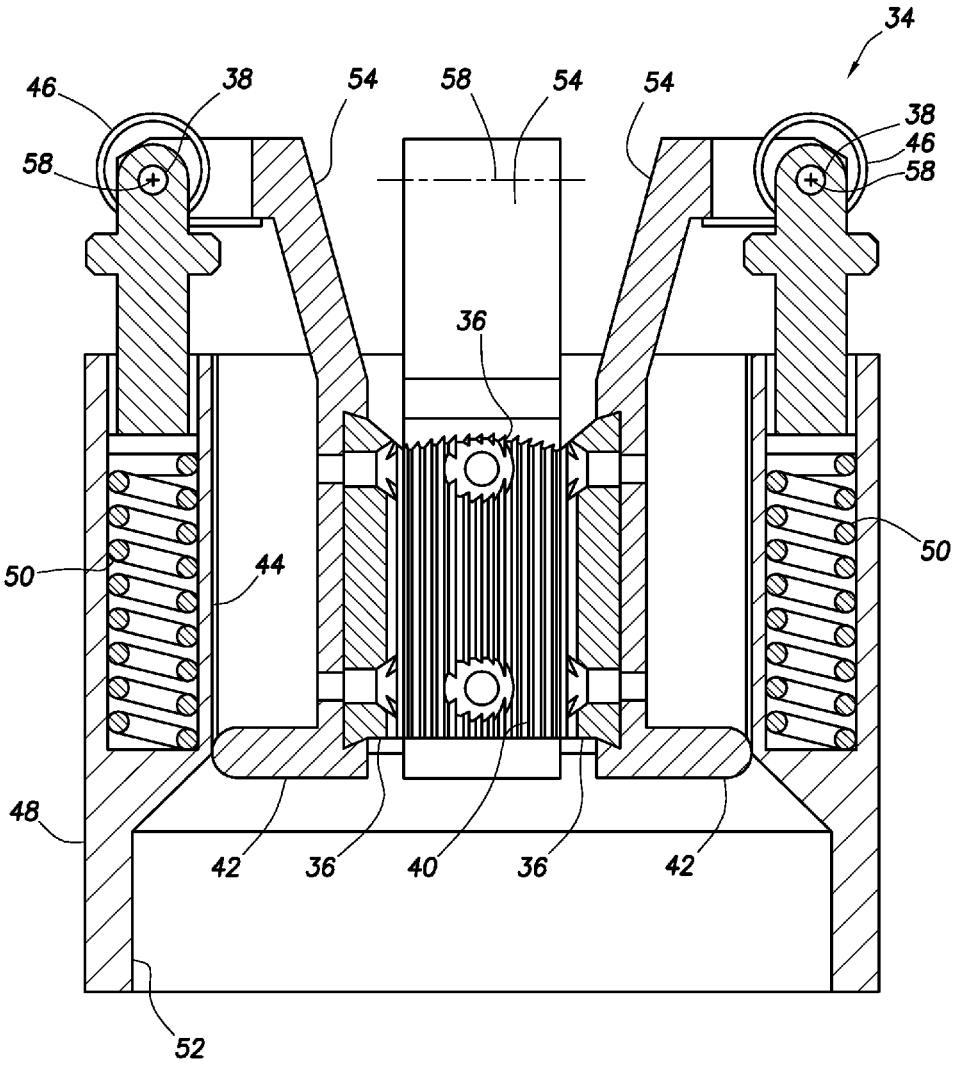
FIG. 4 is a representative cross-sectional view of a gripping device which can be used in the rotating control device of FIG. 3, and which can embody principles of this disclosure.

Referring additionally now to FIG. 4, an enlarged scale cross-sectional view of one configuration of the gripping device 34 is representatively illustrated. In this view, it may be seen that the gripping device 34 includes gripping jaws 36, which are pivotable about pivots 38.

As depicted in FIG. 4, the jaws 36 are fully radially inwardly disposed, in which position the jaws can readily grippingly engage the drill string 12 therein. Teeth 40 are provided on the jaws 36 for gripping the drill string 12, but preferably the teeth are configured so that they do not mar an outer surface of the drill string (which passes through the seal 24), and/or the jaws can be made of a material (such as aluminum, etc.) which has a hardness less than that of the drill string.

Supports 42 inwardly support the jaws 36 when the supports are received in a reduced lateral dimension section 44 of the gripping device 34. Furthermore, torsion springs 46 bias the jaws 36 radially inward into gripping engagement with the drill string 12.

The jaws 36 are also biased upward relative to a body 48 of the gripping device 34 by compression springs 50. In particular, the springs 50 bias the pivots 38 upward, thereby tending to displace the supports 42 into the reduced lateral dimension section 44.

Figure 5:
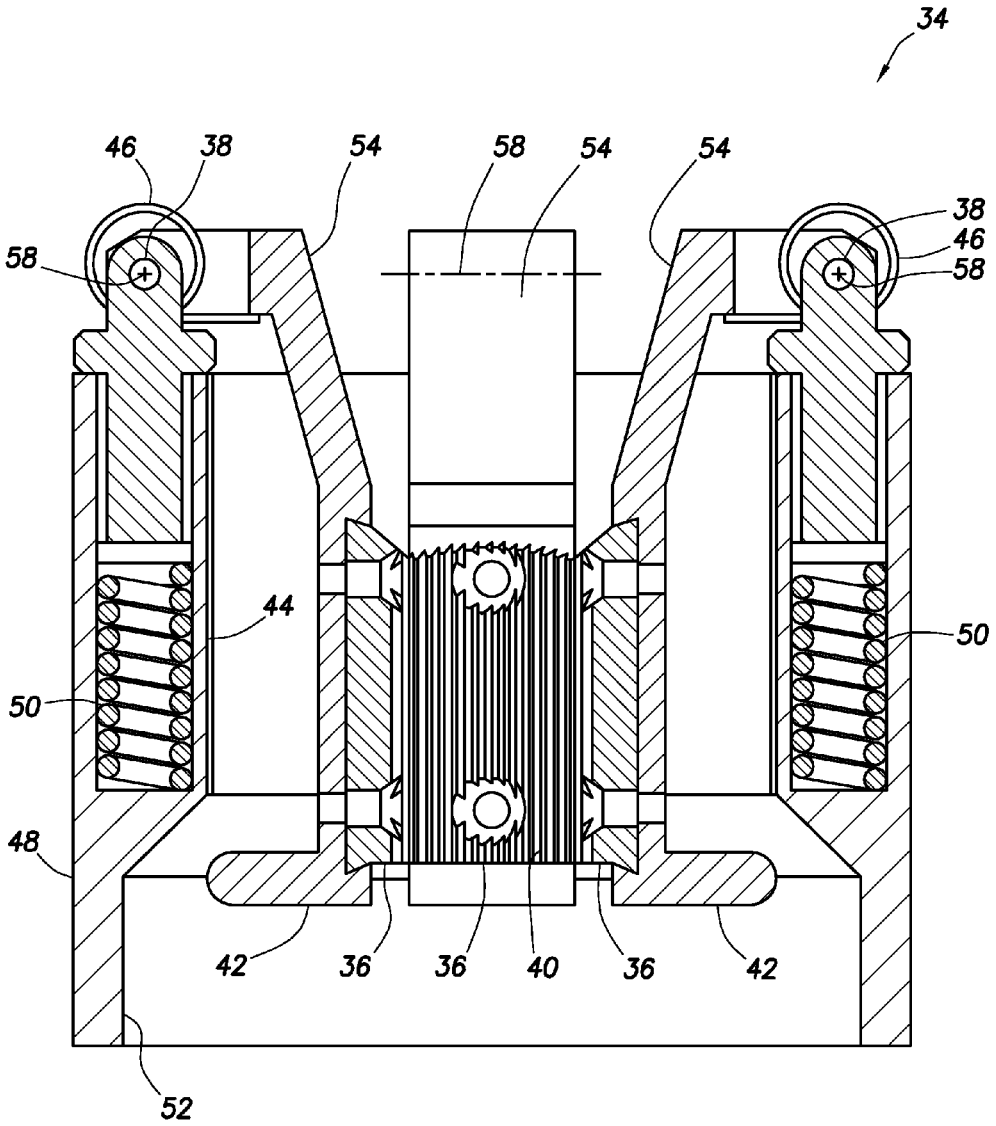
FIG. 5 is a representative cross-sectional view of the gripping device, with gripping jaws thereof in an upper gripping position.

Referring additionally now to FIG. 5, the gripping device 34 is representatively illustrated with the pivots 38 and jaws 36 downwardly displaced relative to the FIG. 4 configuration. In this position of the pivots 38 and jaws 36, the supports 42 are not within the reduced lateral dimension section 44, but are instead within an increased lateral dimension section 52, and so the jaws 36 can pivot outward about the pivots 38.

The configuration of FIG. 5 results from an enlarged diameter part of the drill string contacting an inclined upper surface 54 between each respective pivot 38 and jaw 36. For example, a coupling 56 (such as the one depicted in FIG. 1, but lower on the drill string 12) can displace downward as the wellbore is being drilled, or as the drill string is being tripped into the wellbore. The coupling 56 will contact the inclined surfaces 54, causing the pivots 38 and jaws 36 to displace downward from the FIG. 4 position to the FIG. 5 position, and causing the jaws to pivot outward as needed to allow the coupling to pass through the gripping device 34.

Note that the jaws 36 rotate about axes 58 of the pivots 38 which are transverse relative to the drill string axis 35.

Figure 6:
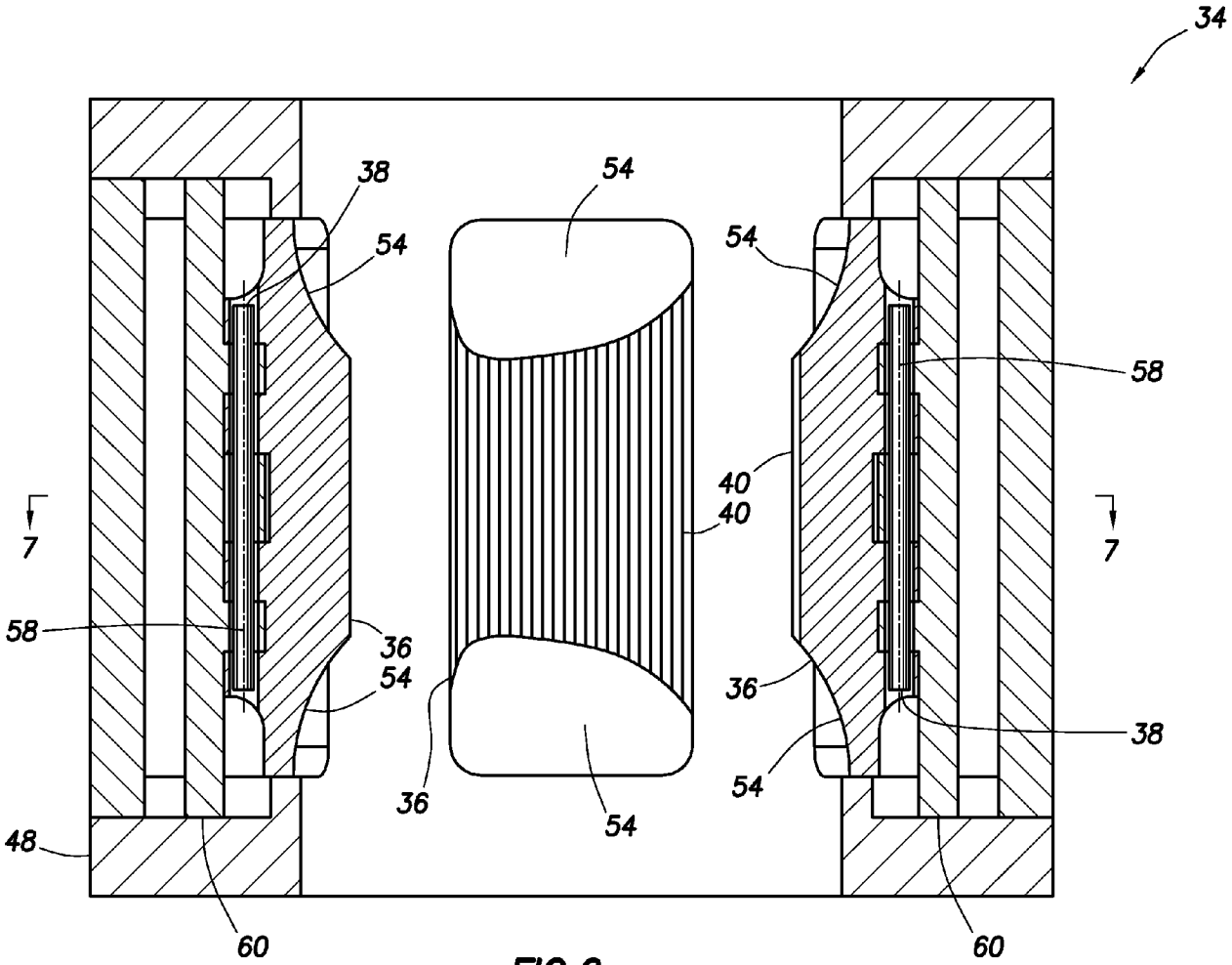
FIG. 6 is a representative cross-sectional view of another configuration of the gripping device.

Referring additionally now to FIG. 6, another configuration of the gripping device 34 is representatively illustrated. In this configuration, the jaws 36 pivot about the pivots 38 which have their axes 58 parallel to the drill string axis 35, and inclined surfaces 54 are provided on upper and lower ends of the jaws.

The jaws 36 are pivotably mounted on carriers 60 which are laterally displaceable relative to the body 48. Biasing devices, such as springs (not shown), may be used to bias the carriers 60 and jaws 36 radially inward relative to the body 48.

The inclined surfaces 54 on the upper and lower ends of the jaws 36 cause the jaws to be displaced radially outward if an enlarged diameter section of the drill string 12 contacts the jaws, whether the enlarged diameter section is being displaced upwardly or downwardly through the gripping device 34. Note that inclined surfaces 54 could be provided on upper and lower ends of the jaws 36 in the configuration of FIGS. 4 & 5, if desired.

Figure 7:
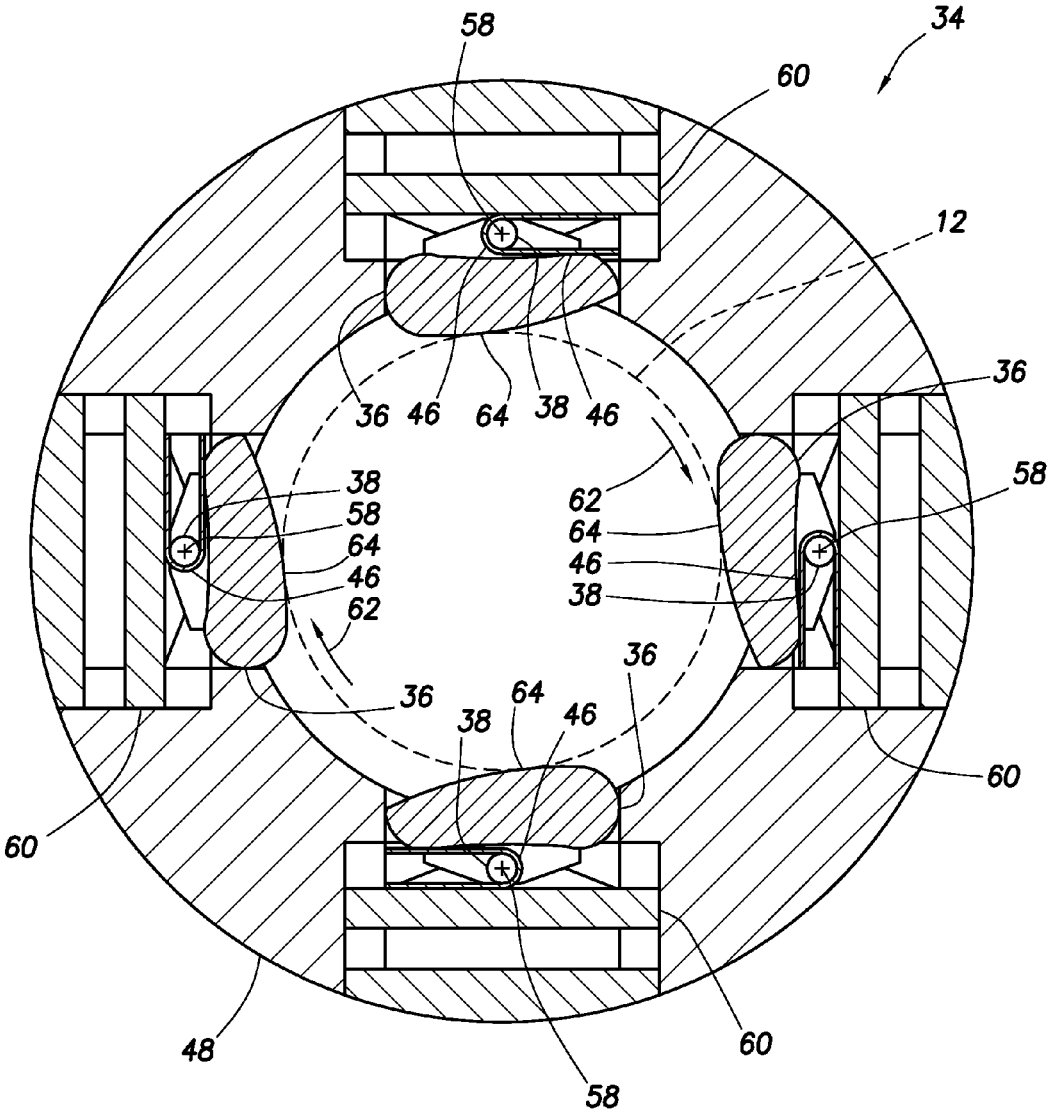
FIG. 7 is a representative cross-sectional view of the gripping device, taken along line 7-7 of FIG. 6.

Referring additionally now to FIG. 7, a cross-sectional view of the gripping device 34, taken along line 7-7 of FIG. 6 is representatively illustrated. In this view it may be seen that the jaws 36 are shaped so that a gripping force exerted by the jaws on the drill string 12 will increase if there is relative rotation between the drill string and the jaws.

Specifically, if the drill string 12 rotates in a clockwise (right-hand) direction as indicated by arrows 62 in FIG. 7, and the jaws 36 grip the drill string (torsion springs 46 continually bias the jaws into gripping engagement with the drill string), then relative rotation between the drill string and the jaws will cause the jaws to pivot counter-clockwise about the pivots 38, thereby causing the gripping force exerted by the jaws on the drill string to increase. This is due to the jaws 36 having radiused gripping surfaces 64 which are eccentric relative to the pivot axes 58.

It may now be fully appreciated that the above disclosure provides several advancements to the art of constructing and operating rotating control devices. The rotating control device 20 mitigates wear of, and damage to, the seal 24 due to relative rotation between the seal and the drill string 12.

The above disclosure describes a rotating control device 20 which can include a rotatably mounted seal 24 which sealingly engages a drill string 12. A gripping device 34 grips the drill string 12, and thereby forces the seal 24 to rotate with the drill string 12.

The gripping device 34 may include a gripping jaw 36 which grips the drill string 12. The gripping jaw 36 may be biased into contact with the drill string 12. The jaw 36 may be displaceable radially relative to the drill string 12.

The jaw 36 may pivot about an axis 58 which is transverse relative to the drill string 12. The jaw 36 may pivot about an axis 58 which is parallel to a longitudinal axis 35 of the drill string 12.

Rotation of the drill string 12 relative to the gripping device 34 can cause a gripping force exerted by the gripping device 34 to increase.

Also described above is a drilling method. The method can include positioning a drill string 12 in a rotating control device 20, gripping the drill string 12 with a gripping device 34 of the rotating control device 20, and rotating the drill string 12, gripping engagement between the gripping device 34 and the drill string 12 causing a seal 24 of the rotating control device 20 to rotate along with the drill string 12.

Rotating the drill string 12 may include increasing a gripping force exerted by the gripping device 34 when the drill string 12 rotates relative to the gripping device 34.

Gripping the drill string 12 may include engaging a gripping jaw 36 of the gripping device 34 with the drill string 12. Engaging the gripping jaw 36 may include pivoting the gripping jaw 36.

The method may also include displacing the gripping jaw 36 radially outward relative to the drill string 12 as an increased diameter section of the drill string 12 displaces through the rotating control device 20.

The method may also include attaching the gripping device 34 to a mandrel 30 of the rotating control device 20, the mandrel 30 being fixed relative to the seal 24.

The above disclosure also describes a well system 10, which can include a drill string 12, and a rotating control device 20 including a seal 24 which sealingly engages the drill string 12, and a gripping device 34 which grippingly engages the drill string 12.

The well system 10 may also include a top drive 18 which rotates the drill string 12.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used for convenience in referring to the accompanying drawings. In general, "above," "upper," "upward" and similar terms refer to a vertical direction upward from the earth's surface, and "below," "lower," "downward" and similar terms refer to a vertically downward direction.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A rotating control device for a drill string, comprising:

a rotatably mounted seal configured to sealingly engage the drill string; and a gripping device comprising a gripping jaw configured to pivot into gripping engagement with the drill string about an axis parallel to a longitudinal axis of the drill string and thereby force the seal to rotate with the drill string, wherein the gripping jaw is biased into contact with the drill string.

2. The rotating control device of claim 1, further comprising a spring configured to bias the gripping jaw into contact with the drill string.

3. The rotating control device of claim 1, wherein the gripping jaw is displaceable radially relative to the drill string.

4. The rotating control device of claim 1, wherein a gripping force exerted by the gripping device is configured to increase upon rotation of the drill string relative to the gripping device.

5. A drilling method, comprising:

positioning a drill string in a rotating control device;

biasing a gripping device of the rotating control device into engagement with the drill string with a biasing device;

gripping the drill string with the gripping device by pivoting a gripping jaw of the gripping device into gripping engagement with the drill string about an axis parallel to a longitudinal axis of the drill string using the bias of the biasing device; and rotating the drill string, the gripping engagement between the gripping device and the drill string causing a seal of the rotating control device to rotate with the drill string.

6. The method of claim 5, wherein rotating the drill string further comprises increasing a gripping force exerted by the gripping device when the drill string rotates relative to the gripping device.

7. The method of claim 5, further comprising displacing the gripping jaw radially outward relative to the drill string as an increased diameter section of the drill string displaces through the rotating control device.

8. The method of claim 5, further comprising attaching the gripping device to a mandrel of the rotating control device, the mandrel being fixed relative to the seal.

9. The method of claim 5, wherein the biasing device comprises a spring.

10. A well system, comprising:

a drill string;

a rotating control device including:

a seal configured to sealingly engage the drill string; and a gripping device comprising a gripping jaw pivotable into gripping engagement with the drill string about an axis parallel to a longitudinal axis of the drill string, wherein the gripping jaw is biased into contact with the drill string.

11. The well system of claim 10, further comprising a top drive configured to rotate the drill string.

12. The well system of claim 10, wherein the gripping device is configured to force the seal to rotate with the drill string.

13. The well system of claim 10, further comprising a spring configured to bias the gripping jaw into contact with the drill string.

14. The well system of claim 10, wherein the gripping jaw is displaceable radially relative to the drill string.

15. The well system of claim 10, wherein a gripping force exerted by the gripping device is configured to increase upon rotation of the drill string relative to the gripping device.

* * * * *